US005755287A

United States Patent [19]

Cain et al.

[11] Patent Number: 5,755,287

[45] Date of Patent: May 26, 1998

[54] SEALING ASSEMBLY FOR SUBSEA WELLHEADS

[75] Inventors: David E. Cain; Gerald B. Swagerty; Robert R. Schoen, all of Houston, Tex.

[73] Assignee: FMC Corporation, Chicago, Ill.

[21] Appl. No.: 627,193

[22] Filed: Apr. 3, 1996

[51] Int. Cl.[6] ..... E21B 33/04

[52] U.S. Cl. ..... 166/368; 166/88.1; 277/236

[58] Field of Search ..... 166/368, 88.1; 277/164, 167.5, 236, 207 A

[56] References Cited

U.S. PATENT DOCUMENTS

| | | | |
|---|---|---|---|
| 2,122,071 | 6/1938 | Rasmussen et al. | 166/88.1 X |
| 4,015,818 | 4/1977 | Tawakol | 277/164 X |
| 4,327,804 | 5/1982 | Reed | 166/88.1 |
| 4,470,609 | 9/1984 | Poe | 277/236 X |
| 4,770,426 | 9/1988 | Kropatsch | 277/236 |
| 4,771,832 | 9/1988 | Bridges | 277/236 X |
| 4,809,989 | 3/1989 | Keinal | 277/164 X |
| 5,246,236 | 9/1993 | Szarka et al. | 277/236 X |
| 5,247,996 | 9/1993 | Milberger | 166/368 X |
| 5,325,925 | 7/1994 | Smith et al. | 166/368 X |
| 5,464,063 | 11/1995 | Boehm, Jr. | 277/236 X |

OTHER PUBLICATIONS

Cameron Iron Works USA, Inc., *Collect Connectors–Engineering Data*, 1988, 1 page, Houston, Texas.

*Primary Examiner*—William P. Neuder
*Attorney, Agent, or Firm*—Henry C. Query, Jr.

[57] ABSTRACT

A sealing assembly (40) for fitting between an upper wellhead connector (12) and a lower wellhead housing or hub 14. Upper wellhead connector (12) has a downwardly facing frusto-conical sealing surface (32) and wellhead housing (14) has an upwardly facing frusto-conical sealing surface (34). Sealing assembly (40) includes a metal ring (42) having annular grooves (58) therein to receive elastomeric sealing elements (60) therein. Elastomeric sealing elements (60) have extending lips (62) for contacting and sealing against adjacent sealing surfaces (32, 34) spaced from opposed frusto-conical surfaces (54, 56) on the metal ring (42) to provide elastomeric seals for the sealing surfaces (32, 34) of wellhead connector (12) and wellhead housing (14).

2 Claims, 4 Drawing Sheets

SEALING ASSEMBLY FOR SUBSEA WELLHEADS

BACKGROUND OF THE INVENTION

1. Field of the Invention

This invention relates to subsea wellheads, and more particularly to a sealing assembly for sealing between an upper wellhead connector and a lower wellhead housing.

2. Description of Related Art

Heretofore, seals or sealing assemblies have been provided between a subsea wellhead housing at the subsea floor and a subsea connector which is lowered onto the wellhead housing for assembly. It is important that effective seals be provided between the subsea connector and the wellhead housing as repair or servicing of seals for subsea wellheads is expensive and oftentimes impractical.

Metal seals have commonly been used for sealing between a subsea wellhead connector and a wellhead housing or hub. For example, U.S. Pat. No. 5,103,915 dated Apr. 14, 1992 is directed to a metal sealing assembly in which primary and secondary metal sealing surfaces are provided. It is well known that various imperfections occur on sealing surfaces, such as scratches, pitting, and being out of round or warped, for example. Also, manufacturing tolerances may be excessive. Many seals, particularly metal seals, do not provide effective sealing when such scratches, pitting, and out of round characteristics as well as relatively large manufacturing tolerances exceed a certain maximum amount. It is, of course, desirable that imperfections or increased dimensions in sealing surfaces be acceptable and that increased manufacturing tolerances may be utilized so that rejects are held to a minimum.

Some prior art sealing assemblies for subsea wellheads have utilized elastomeric seals mounted in annular grooves on a metal gasket or metal ring. However, such elastomeric seals have not been secured within the grooves and oftentimes during installation or field servicing of the sealing assembly, the elastomeric ring is rolled out of the groove. Further, especially under high fluid pressures, an unsecured elastomeric ring may extrude out of the groove into the gap between the sealing surfaces. It is desirable that an elastomeric seal be provided for a subsea wellhead assembly which maintains an effective seal against sealing surfaces of increased imperfections.

SUMMARY OF THE INVENTION

The present invention provides a sealing assembly between a wellhead connector and a wellhead housing or hub which is effective in sealing even though substantial imperfections such as pitting, scratches, excessive manufacturing tolerances and out of round characteristics are found on the sealing surfaces of the wellhead connector and wellhead housing.

The sealing assembly of the present invention fits between interfitting ends of an upper wellhead connector and a lower wellhead housing. Sealing surfaces on the wellhead connector and the wellhead housing are of a frusto-conical shape and the sealing assembly is particularly adapted for sealing between a downwardly facing frusto-conical sealing surface on the upper wellhead connector and an adjacent upwardly facing frusto-conical sealing surface on the lower wellhead housing. The sealing assembly includes a metal ring having upper and lower ends with an outer radially extending circumferential portion adjacent each of the ends defining an annular recessed portion or groove between the radially extending circumferential portions adjacent the upper and lower ends of the metal ring. The radially extending circumferential portions form upper and lower frusto-conical surfaces positioned generally in opposed relation to the frusto-conical sealing surfaces of the upper wellhead connector and lower wellhead housing. An annular groove in each of the upper and lower frusto-conical surfaces of the ring receives an elastomeric sealing element therein for sealing against the opposed sealing surface of the wellhead assembly. The elastomeric sealing element has an outer extending lip or protuberance engaging the adjacent sealing surface to provide a seal for any gap existing between the metal ring and the adjacent sealing surfaces of the wellhead assembly. The elastomeric sealing element when compressed or deformed into sealing engagement with the adjacent sealing surface is compressed to a certain percentage, e.g., about 10 to 20 percent, of its thickness to provide an effective elastomeric seal. As a result, substantial imperfections on the sealing surfaces of the wellhead assembly, including scratches, pitting, excessive tolerances, or out of round or warpage characteristics, may be accommodated.

A gap between the sealing surfaces of the wellhead connector and wellhead housing and the opposed metal surfaces of the metal ring of the sealing assembly is effectively sealed. Likewise, a scratch in a sealing surface may be effectively sealed by the sealing assembly of the present invention utilizing only an elastomeric seal. In addition, the sealing assembly of the present invention is adapted for sealing against fluid pressure from either side of the elastomeric sealing element thereby providing an effective bidirectional sealing assembly.

Other features and advantages of the invention will be apparent from the following specification and drawings.

BRIEF DESCRIPTIONS OF THE DRAWINGS

DETAILED DESCRIPTION OF THE PREFERRED EMBODIMENTS

Figure 1:
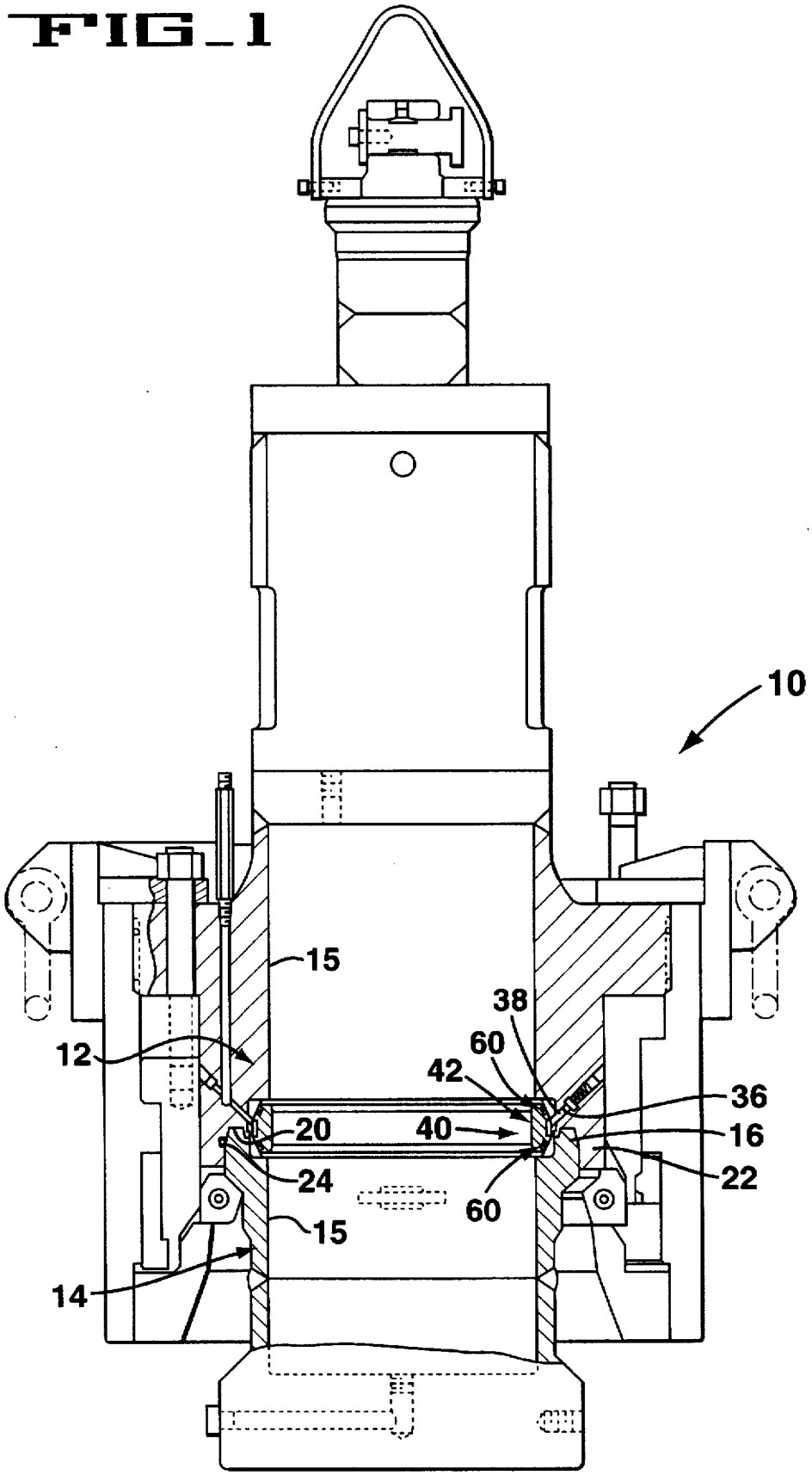
FIG. 1 is a sectional view of a subsea connector assembly for an upper wellhead connector and a lower wellhead housing or hub and showing a sealing assembly comprising the present invention mounted between the upper wellhead connector and the lower wellhead housing.

Referring now to the drawings for a better understanding of this invention, and more particularly to FIG. 1, a wellhead connector assembly is shown generally at 10 for a subsea installation for connecting an upper wellhead connector generally indicated at 12 to a lower wellhead housing or hub generally indicated at 14. Wellhead housing 14 is normally cemented to the subsea floor and wellhead connector 12 is normally lowered from a surface vessel onto wellhead housing 14 for connecting a subsea well to the surface or to a collection facility on the subsea floor. A central bore 15 extends through wellhead connector 12 and wellhead housing 14.

Figure 2:
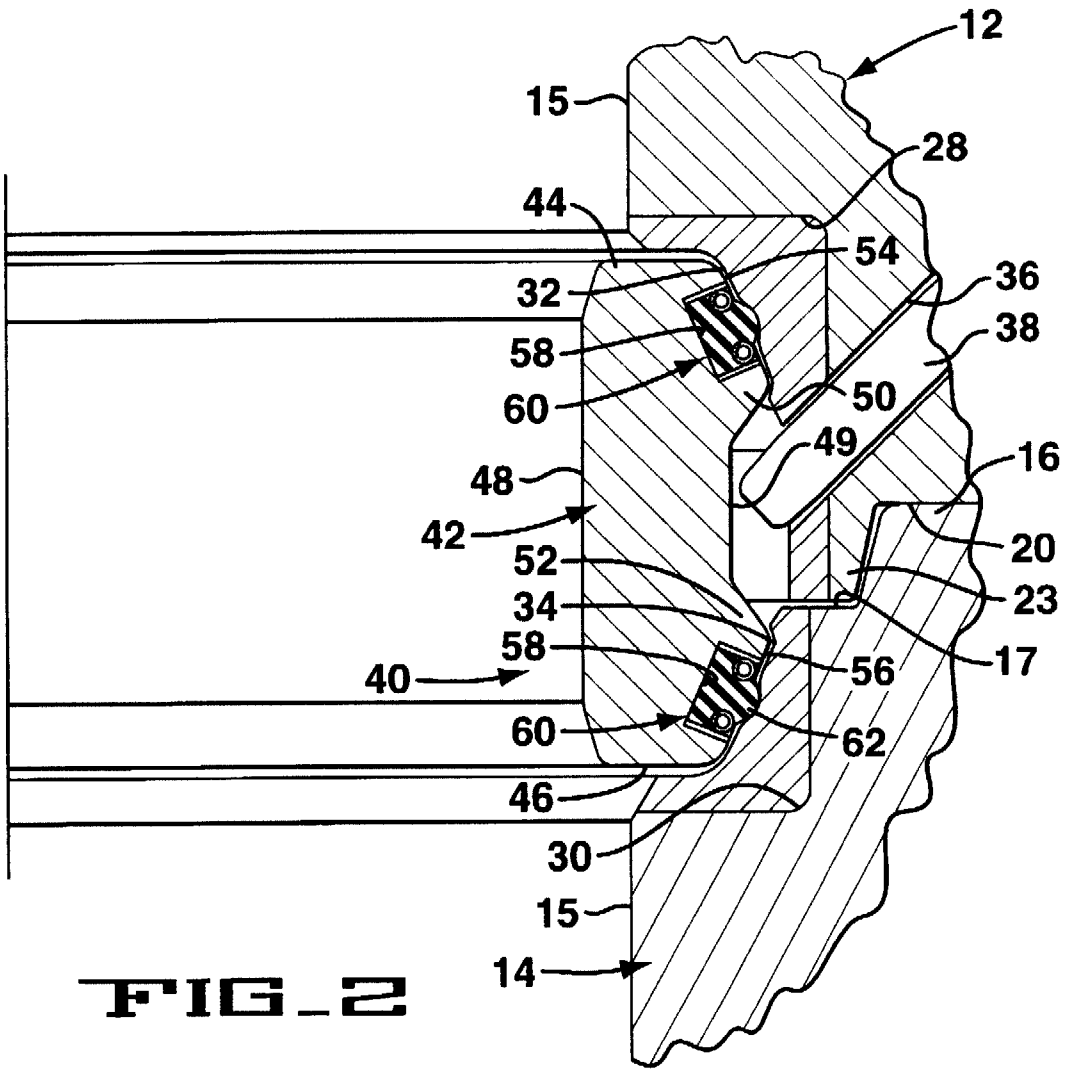
FIG. 2 is an enlarged sectional view of the sealing assembly of FIG. 1 shown in an assembled position between an upper wellhead connector and a lower wellhead housing with the sealing assembly extending between frusto-conical sealing surfaces on the wellhead connector and the wellhead housing.

The upper end of wellhead housing 14 has a vertically extending annular rim or shoulder 16 and an inner annular horizontal ledge or abutment 17, as shown particularly in FIG. 2. Wellhead connector 12 has a lower circumferential groove 20 facing downwardly to receive upper shoulder 16 and an outer circumferential flange 22 extending about the outer circumference of shoulder 16 in an interfitting relation. An annular lip 23 on connector 12 is spaced slightly from abutment 17 in the connected position, as shown in FIG. 2. The adjacent surfaces of shoulder 16 and outer flange 22 are tapered so that wellhead connector 12 may be easily lowered and landed on wellhead housing 14 for connection thereto by suitable connection means, as is well known to those skilled in the art. An O-ring 24 seals between outer flange 22 and shoulder 16.

Wellhead connector 12 has an inner annular pocket 28 at its lower end and wellhead housing 14 has an inner annular pocket 30 at its upper end in generally opposed relation to pocket 28. A downward facing frusto-conical sealing surface 32 is formed in wellhead connector 12 at pocket 28 and upwardly facing frusto-conical sealing surface 34 is formed in wellhead housing 14 at pocket 30. Surfaces 32 and 34 are preferably formed of a corrosion resistant alloy material, such as "Inconel", and preferably have a high hardness, such as between about 22 to 35 Rockwell C. The hard material is fixed within pockets 28 and 30 by welding, for example, and subsequent machining to the desired finish for the sealing surfaces 32 and 34. Surfaces 32 and 34 extend at an angle, e.g., around 23 degrees, relative to the longitudinal axis of bore 15. An angle of at least around 5 degrees relative to the longitudinal axis of bore 15 is typically required for satisfactory sealing. A plurality of ports 36 extend through the wall of wellhead connector 12 to receive retainer pins or screws 38.

The sealing assembly of the present invention is shown generally at 40 and is adapted for sealing between sealing surfaces 32 and 34. Sealing assembly 40 includes a metal ring generally indicated at 42 having an inner peripheral surface 48 and a width defined between respective upper and lower ends 44, 46. Ring 42 is recessed centrally of its width between ends 44 and 46 by an outer circumferential recessed groove 49. An upper radially extending outer portion or land 50 is defined adjacent upper end 44 and a lower radially extending outer portion or land 52 is defined adjacent lower end 46. Outwardly extending portions 50 and 52 are separated by recessed groove 49. Upper radially extending portion 50 has an upwardly facing frusto-conical surface 54 and lower radially extending portion 52 has a downwardly facing frusto-conical surface 56. Frusto-conical surfaces 54 and 56 extend generally parallel to the respective opposed frusto-conical sealing surfaces 32 and 34. Sealing assembly 40 is mounted on wellhead connector 12 by the insertion of retaining pins 38 within groove 49 prior to lowering of wellhead connector 12 onto wellhead housing or hub 14. Metal ring 42 preferably has a hardness which is lower than the hardness of surfaces 32 and 34, such as between about 65 to 83 Rockwell B.

Figure 3:
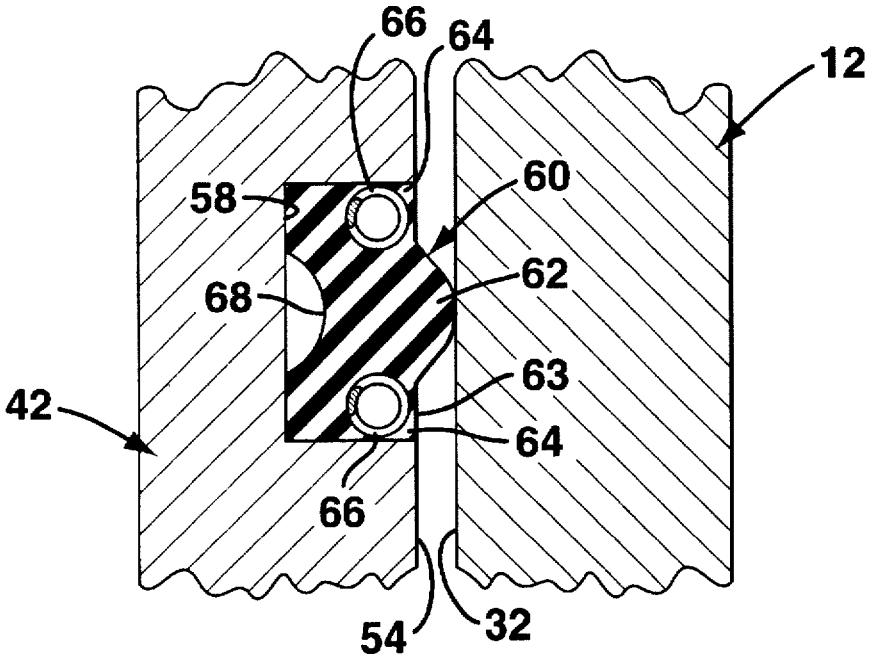
FIG. 3 is an enlarged fragment of FIG. 2 showing a preferred embodiment of the elastomeric sealing element for the sealing assembly mounted with in an annular groove in the metal ring of the sealing assembly.
Figure 4:
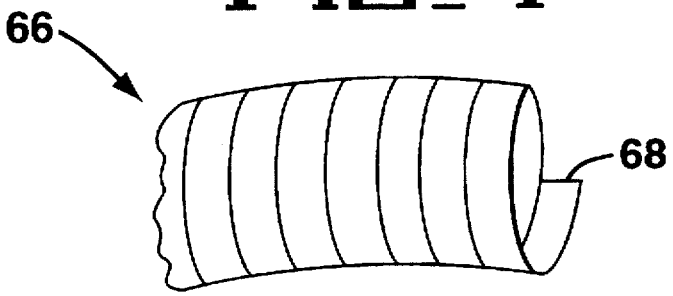
FIG. 4 is an elevational view of a portion of a spring member removed from the preferred elastomeric sealing element of FIG. 3 in which it is embedded.
Figure 4A:
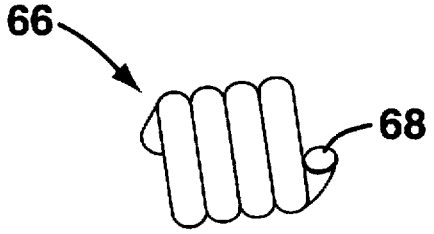
FIG. 4A is an elevational view of another embodiment of the spring member depicted in FIG. 4.
Figure 5:
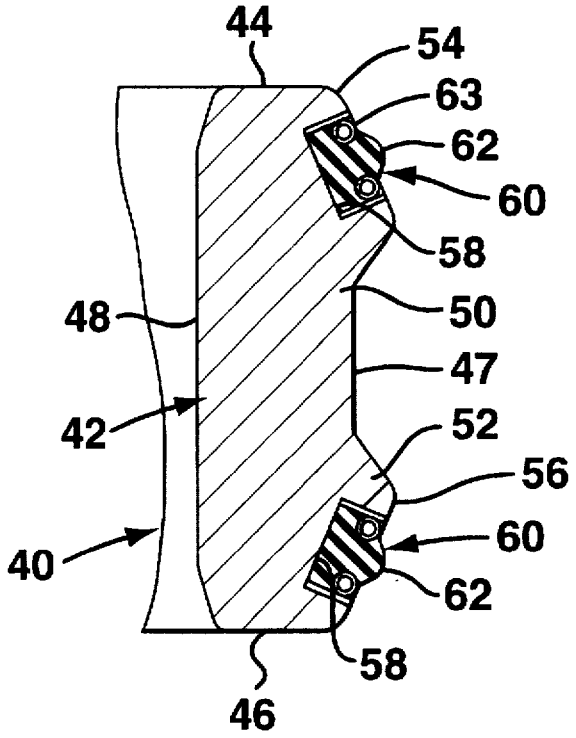
FIG. 5 is an enlarged sectional view of the sealing assembly of the present invention shown removed from the wellhead connector and wellhead housing.

Formed in each frusto-conical surface 54 and 56 is an annular groove 58. Mounted in each groove 58 in an elastomeric sealing element or ring generally indicated at 60. Elastomeric sealing element 60 as shown particularly in FIGS. 3 and 5 is generally rectangular in cross section and includes a central convex protuberance or lip 62 extending outwardly from front surface 63 of sealing element 60 and outwardly from frusto-conical surface 54 for engaging opposed sealing surface 32 on wellhead connector 12. Front surface 63 of sealing element 60 is generally flush with surface 54. Lip 62 is deformed and compressed against opposed sealing surface 32 in sealing relation. Sealing element 60 has front corners 64 adjacent lip 62. Embedded in the elastomeric body of sealing element 60 adjacent each front corner 64 is an annular spring member 66. Annular spring members 66 provide resistance to deformation at front corners 64 and act as anti-extrusion elements for sealing elements 60. Spring member 66 may be made, for example, from metallic or composite plastic materials which bond strongly to the body of sealing element 60. As shown in FIG. 4, each spring member 66 is preferably made of a ribbon-like continuous filament 68 which is coiled in a helical arrangement to form an extension spring. Alternatively, spring member 66 may comprise a coiled tubular filament 68, as shown in FIG. 4A. Filament 68 may be formed of a metallic material such as stainless steel, or a composite plastic material including plastic, graphite, or glass fibers, for example. Spring 66 may be formed of multiple strand coils or braided coil springs. The finished springs 66 may be cut to required lengths and connected at the ends to create annular spring shapes as desired. The utilization of spring members 66 permits sealing elements 60 to be snapped or pressed into grooves 58 for retention without normally requiring any separate securement within grooves 58. However, under certain conditions it may be desirable to mold the body of elastomeric sealing element 60 within groove 58. For further details of elastomeric sealing element 60, reference is made to co-pending application Ser. No. 08/216,004 filed on Mar. 22, 1994.

When in a compressed position under fluid pressure, a compression of the body of sealing element 60 is obtained. Sealing element 60 may be formed from synthetic rubber, such as a nitrite rubber having a Shore A durometer of about 75.

It is important that the elastomeric sealing element or ring 60 be positively retained within groove 58 so that sealing element 60 is not rolled out of groove 58 during assembly or field servicing and does not extrude into the gap between surfaces 32 and 54 when exposed to high fluid pressures. When utilizing a preferred embodiment of sealing element 60 as shown in FIG. 3 with metallic springs 66, sealing element 60 may be snapped or pressed into groove 58 and retained in position within groove 58 during assembly and during operation. However, under some conditions, it might be desirable to mold the sealing element within groove 58 by the application of heat and pressure. In some instances, suitable adhesives may be utilized for securing the sealing element within groove 58, or the sealing element may be mounted within a dove-tail groove. In one embodiment of the present invention, an annular groove 68 may provided on the rear surface of sealing element 60 to provide additional volume or void area for deformation of sealing element 60.

Sealing element 60 is effective for sealing damaged wellhead connectors and wellhead hubs. For example, sealing element 60 is effective in sealing imperfections such as (1) scratches on sealing surfaces, (2) a surface finish having a roughness, (3) pitting, (4) an out of round or warpage, and (5) manufacturing tolerances over the specified design dimensions shown on the drawings or prints. Sealing element 60 is a bidirectional seal and is normally designed to seal internally and externally at various fluid pressures. Additionally, sealing element 60 is designed to withstand high temperatures and has excellent chemical resistance. Thus, sealing element 60 is effective for sealing under a wide range of surface conditions. It may be desirable in some instances for metal ring 42 to have a minimal metal to metal contact with surfaces 32 and 34 as an additional seal.

Figure 6:
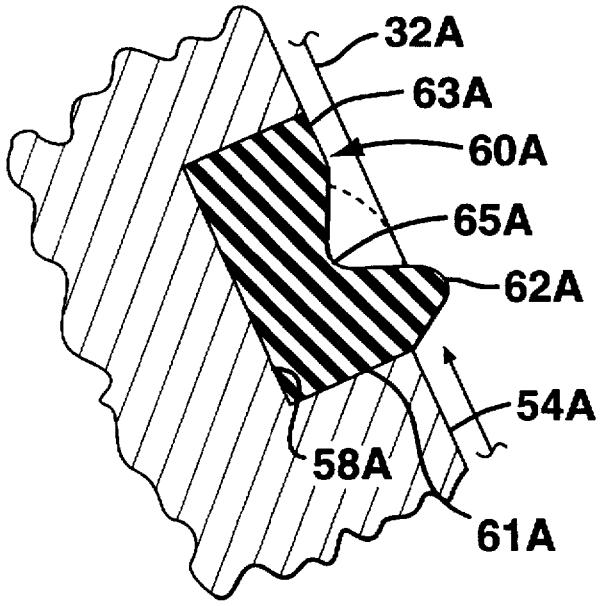
FIG. 6 is an enlarged sectional view of another embodiment of an elastomeric sealing element secured within an annular groove of the metal ring.

Referring to FIG. 6, a modified sealing element 60A molded in groove 58A is shown in which an outer lip 62A extends outwardly from side 61A of sealing element 60A. An annular depression or recess 65A is provided adjacent lip 62A and provides a void area to receive lip 62A when lip 62A is compressed from a direction indicated by the arrow. Lip 62A is shown in broken lines in a compressed relation in engagement with sealing surface 32A.

While the preferred embodiments of the present invention have been illustrated in detail, it is apparent that modifications and adaptations of the preferred embodiments will occur to those skilled in the art. However, it is to be expressly understood that such modifications and adaptations are in the spirit and scope of the present invention as set forth in the following claims.

What is claimed is:

1. A sealing assembly for fitting between interfitting ends of an upper wellhead connector and a lower wellhead housing, said upper wellhead connector having an inner frusto-conical sealing surface facing downwardly adjacent the lower end of said upper wellhead connector and said lower wellhead housing having an inner frusto-conical sealing surface facing upwardly adjacent the upper end of said upper wellhead housing; said sealing assembly comprising:

a metal ring having outer radially extending circumferential portions adjacent upper and lower ends of the metal ring, said radially extending portions defining upper and lower frusto-conical surfaces positioned generally in opposed relation to said respective frusto-conical sealing surfaces of said upper wellhead connector and said lower wellhead housing;

an annular groove in each of said upper and lower frusto-conical surfaces of said ring; and an elastomeric sealing element mounted within each of said annular grooves for sealing against said sealing surfaces of said upper wellhead connector and said lower wellhead housing;

said elastomeric sealing element having an outer circumferential lip extending outwardly from the adjacent frusto-conical surface of said ring; and said elastomeric sealing element having an annular depressed area adjacent said lip and extending inwardly of said adjacent frusto-conical surface of said ring, said lip being deformed into said annular depressed area for sealing against an associated sealing surface.

2. In a wellhead connector assembly including a lower wellhead housing having an upwardly facing frusto-conical sealing surface on its upper end and an upper wellhead connector having a downwardly facing frusto-conical sealing surface on its lower end, and complementary interfitting means on said wellhead connector and wellhead housing for axial alignment of said wellhead connector and wellhead housing for connection to each other; an improved sealing assembly positioned between said sealing surfaces comprising:

a metal ring having a width defined between upper and lower ends thereof and having an outer radially extending circumferential portion adjacent each of said ends defining an annular groove between said radially extending circumferential portions;

said radially extending portions forming upper and lower outer frusto-conical surfaces positioned generally in opposed relation to said respective frusto-conical sealing surfaces of said upper wellhead connector and said lower wellhead housing;

an annular groove in each of said upper and lower frusto-conical surfaces of said ring;

an elastomeric sealing element mounted within each of said annular grooves for sealing against said sealing surfaces of said upper wellhead connector and said lower wellhead housing;

said elastomeric sealing element having an outer circumferential lip extending outwardly from the adjacent outer frusto-conical surface of said ring; and said elastomeric sealing element having an annular depressed area adjacent said lip and extending inwardly of said adjacent frusto-conical surface of said ring, said lip being deformed into said annular depressed area and sealing against an associated sealing surface.

* * * * *